US005938048A

United States Patent [19]

Carroll et al.

[11] Patent Number: 5,938,048

[45] Date of Patent: Aug. 17, 1999

[54] MODULAR TIERED RACK ASSEMBLY

[75] Inventors: Francis Alfred Carroll; Oliver McElvanny, both of Dublin, Ireland

[73] Assignee: Carroll Products and Designs Limited, Dublin, Ireland

[21] Appl. No.: 08/849,390

[22] PCT Filed: Nov. 30, 1995

[86] PCT No.: PCT/IE95/00060

§ 371 Date: May 30, 1997

§ 102(e) Date: May 30, 1997

[87] PCT Pub. No.: WO96/16579

PCT Pub. Date: Jun. 6, 1996

[30] Foreign Application Priority Data

Nov. 30, 1994 [IE] Ireland ..... S940941
Jun. 29, 1995 [IE] Ireland ..... S950484

[51] Int. Cl.[6] ..... A47F 5/00
[52] U.S. Cl. ..... 211/55
[58] Field of Search ..... 211/55, 52, 128.1

[56] References Cited

U.S. PATENT DOCUMENTS 5,184,737 2/1993 Hardy ..... 211/55
5,758,781 6/1998 Lord et al. ..... 211/55

FOREIGN PATENT DOCUMENTS 1482997 8/1977 United Kingdom ..... 211/55

*Primary Examiner*—Alvin C. Chin-Shue
*Assistant Examiner*—Sarah Purol
*Attorney, Agent, or Firm*—Hoffmann & Baron, LLP

[57] ABSTRACT

A modular tiered rack assembly includes at least two merchandise support racks suspended in a tiered configuration and brackets for fixing the tiers of racks to a support structure. Each rack has formations which enable it to be fixed to the brackets and/or to the rack above it in the tiered configuration. The brackets include an anchor bracket engageable with the support structure and the uppermost rack and at least one hanger bracket removably suspendable from the anchor bracket. The anchor and hanger brackets have landings for supporting the base of a rack. The racks are fixed to the brackets by suction pads and act as tie elements, whereby the structure formed by the brackets and the tie elements is of a stable construction. The tie elements can be one or more of the racks or a separate tie bar.

36 Claims, 12 Drawing Sheets

FIGUR 6c

MODULAR TIERED RACK ASSEMBLY

BACKGROUND OF THE INVENTION

The present invention relates to a tiered rack assembly, and in particular to a modular tiered rack assembly for displaying and merchandising consumer products. A rack assembly should be understood to be an arrangement of racks or channel components for supporting merchandise.

EP-0 295 869 B discloses a modular tiered rack assembly for merchandising flat or flat packed products. That assembly features a hanging means comprising an extruded profile (or pressing) which is shaped so as to connect a first (or starter) 'J' shaped rack component to slotted wall panelling. The extrusion connects to a hook-over detail on the longer leg of the 'J' shaped rack and its dog-legged shaped back connects to routed slots in the slotted wall panels thus providing the hanging means for the first or starter rack.

The second rack connects to the first rack by means of the same hook-over detail and so on for as many tiers as are required for a particular merchandising situation. The multi-tiered assembly is kept spaced apart from the wall surface by means of removable support rods which attach to the back of the rack components by means of receiver sockets while the racks are suspended from the first hanging means.

While this known structure is ideal for lightweight products such as greeting cards, hosiery etc. it has been found to be less than satisfactory for heavier products such as magazines, picture frames etc. and particularly as larger capacity racks are required by the market place, thus increasing the load factor considerably.

Furthermore, the known rack system, which is designed for hanging from slotted wall panels is not ideally suitable for hanging on modular metal shelving equipment which is used extensively throughout the shopfitting and retail industries, particularly in the supermarket, convenience and forecourt market sectors.

Modular metal shelving equipment generally comprise (a) box or tube section slotted metal upright structural members (hereinafter referred to as the structure) spaced at various intervals from 500 mm to 1500 mm centre to centre apart and varying in height from 500 mm to 3000 mm;

(b) box section or pressed metal base leg support members connecting to the base of the metal uprights to create a stable structure, either L shape for single sided wall located units or inverted T shape for double sided free-standing "gondola" type structures;

(c) metal, timber or hardboard back infill panels interconnecting with the tubular uprights by various fixing means; and (d) pressed metal shelves bracketed to connect to slotted uprights at required locations anywhere along the height of the uprights.

The components of these shelving systems are modular and generally connect together, with minimum use of tools or expertise.

OBJECT AND SUMMARY OF THE INVENTION

The present invention provides an improvement in the supporting arrangement of the rack assembly disclosed in European Patent No. 0 295 869 B1 in order to make it possible:

a. to carry heavier loading than is possible with the known rack assembly structure.

b. to introduce larger capacity racks to the rack assembly range of profiles.

c. to connect the rack system to the all known modular metal shelving equipment predominant in the retail marketplace.

d. to retain the modular versatility in use of the original rack system.

e. to eliminate the problems associated with socket and rod type supports (e.g.—weak back panels, loss of rods, breakages of sockets and the like.

The present invention provides a modular rack or shelf assembly comprising a pair of anchor brackets, each bracket being removably engageable with a generally upright support member and each bracket including means for supporting a demountable display rack or shelf spanning between the brackets, characterised in that the assembly further includes an elongate tie element removably engageable with each bracket, the tie element and/or bracket having fixing means for enabling the tie element and bracket to be securely connected to one another to provide a stable construction.

One or more hanger brackets are conveniently connectable to the anchor brackets and to other hanger brackets so connected, each being removably suspendable from the lowest previously suspended anchor bracket or hanger bracket to construct a tiered merchandise display support structure.

Conveniently, the rack functions as the tie element, with each bracket having means for fastening the rack thereto. The fastening means comprises suction pads fixed to the brackets. Alternatively, the elongate tie element comprises a tie bar engageable to and between the brackets and the fixing means comprises a pair of toothed ends on the tie bar and a locking orifice in each bracket, each toothed end being engageable with a locking orifice. Each toothed end may include a plurality of teeth spaced along the length of the tie bar so that variations in the width of the rack or shelf can be accommodated by the same length of tie bar. The fixing means may further include an orifice formed in the toothed end of the tie bar, said orifice being engageable with a peg provided in the locking orifice in the bracket.

The present invention further provides a modular tiered rack or shelf assembly comprising at least two merchandise support racks or shelves suspended in a tiered configuration and rack or shelf support means for fixing the tier of racks or shelves to a support structure or surface, each rack or shelf having formations which enable it to be removably fixed to the support means and/or to the rack or shelf above it in the tiered configuration, the rack or shelf support means comprising an anchor bracket engageable with the support structure or surface and the uppermost rack or shelf, characterised in that the rack or shelf support means includes at least one hanger bracket removably engageable with the anchor bracket, with at least one of the anchor or hanger brackets having means for supporting the base of a rack or shelf.

Further hanger brackets are conveniently connectable to the assembly, each being removably engageable with the lowest previously suspended hanger bracket to provide a tiered support structure to support the tiered racks.

The anchor and hanger brackets are conveniently engageable by means of co-operating formations formed in the anchor and hanger brackets. In a preferred arrangement, the co-operating formations comprise a hook element formed in one bracket and a slot formed in the other bracket. Each hanger bracket is preferably provided with both a hook element and a slot to enable the hanger bracket to be connected with a higher and lower member in the tiered assembly. Most preferably, the slot is angled from vertical, and the slot in a hanger bracket to be connected to the assembly co-operates with the hook element of the lowest bracket of the tiered assembly, so that the newly-connected bracket drops under its own weight until the hook element and slot interengage tightly by abutment to secure the brackets together.

The anchor bracket is engageable with the support structure by fixing means, which preferably comprises a key engageable with a slot in the support structure. The key should preferably provide a plurality of fixing positions to enable the spacing between the structure or surface and the anchor member to be adjusted. In this way, variations in the distance between the support surface slot and the surface against which the anchor bracket bears in use can be accommodated in different modular shelving systems while using the same anchor bracket. It is also encompassed within the scope of the invention to provide at least one further fixing means associated with the anchor bracket and/or the connected hanger bracket, to provide extra stability against rocking or rotation of the assembly. Conveniently, the further fixing means is vertically slidable relative to the anchor or hanger bracket members.

It is preferred that the anchor bracket and/or hanger bracket include means for stabilizing the assembly against movement relative to the support structure. The stabilizing means conveniently comprises a return for engaging about an edge of the support structure.

Where the display is supported on slotted uprights, then the provision of a slidable fixing means enables the assembly to be secured to two positions on the upright irrespective of variations between slot centres on the upright. It is convenient for example to fix the tiered assembly to the upright at its base as well as its top to prevent any swinging motion of the assembly occurring.

Conveniently, the anchor or hanger bracket member comprises a stepped portion for supportingly receiving the base of a channel.

In a preferred embodiment, the display system includes two channel support brackets for supporting a rack between them, the brackets being mirror-images of one another.

Conveniently, one or more pairs of brackets includes means for fastening a rack thereto.

The pressed metal bracket assembly is designed to connect directly into slotted box or tube section steel uprights, common to the majority of modular metal shelving equipment, thereby utilising the strongest structural element of the shelving system to carry the heavier loading referred to. The support structure of the invention comprises right hand and left hand brackets which connect to every alternate upright and which hang independently of one another thus providing for every dimensional variation from centre to centre of the shelving system uprights without modification and, consequently, for every dimensional variation of the channels which are made to match the shelving system module sizes. The same 'J' shaped channels as used in the original rack system (as shown in EP-B-0295864) span from right hand bracket to left hand bracket and thus complete the new rack assembly.

Each rack comprises a "J" shaped channel which has a lower front wall and a higher rear wall provided with a turned over hook element which can engage with the lower front wall of another 'J' shaped channel to enable one to be suspended from the other. The 'J' shaped channels are usually made from a transparent plastics material such as acrylic so that the merchandise in the racks is visible to a purchaser although one or more of the racks can be fabricated in metal.

The bracket assembly of the invention is of modular construction to match the versatility of the rack system. The anchor bracket (for a single tier rack) has a single connector (a dragon tooth connector, or indeed any suitable fixing means) to hang the bracket from a slotted metal upright of the shelving equipment. This single connector allows the bracket to be used on uprights of various pitches without modification (pitches of slots can vary from 30 mm to 50 mm centres depending on manufacturers and retailer specification). The multi-tooth feature of this element allows the bracket to be used on various shelving systems where the back panel returns vary from flush to 30 mm proud, again depending on the manufacturer. It is important to note that the positioning of the connector element and the right angle return on the anchor bracket in the first embodiment are critical to the structural stability of the bracket in position as they act in union with one another to prevent rotation of the bracket. Where back panels are flush with the slotted upright it is desirable to incorporate a second connector to place in another slot of the upright thus ensuring the stability of the brackets. This second connector can be adjustable to cater for different pitches of slots or can be fixed to suit specific shelving systems. The anchor bracket also incorporates a connector means for hanging the first 'J' shaped rack system component comprising an offset angled metal upstand on to which the hook-over detail of the 'J' shaped rack component connects and spans from the right hand bracket to the left hand bracket to complete the structure.

The anchor bracket incorporates two offset and angled hook fittings punched out of the metal surfaces as connector means for hanging the second tier bracket (or hanger bracket) from the anchor bracket.

The hanger bracket connects to the anchor bracket by means of two offset and angled slots which coincide with the hook fittings on the anchor bracket. When offered up to the anchor bracket, the hanger bracket easily connects to it and they automatically lock together by gravity of self weight and, thereafter, will lock tighter together when the racks are loaded with merchandise The second hanger bracket may have a support landing for the second 'J' shaped rack which when hooked over the leading edge of the first 'J' shaped rack and supported by the right hand and left hand brackets is capable of carrying much heavier loads than the structure disclosed in EP 0 295 869 B. Various alternative configurations of brackets and landing support arrangements are shown in the accompanying drawings.

The third hanger bracket connects to the second hanger bracket in similar fashion as the second hanger bracket connects to the first and so on for the fourth tier etc., if required.

This arrangement of easily assembled and easily dismantled modular brackets ensures that the modular advantages of the rack system are maintained while improving the load carrying capacity of the system.

Much larger capacity racks can now be added to the rack system range of profiles to cater for large volume retail outlets such as supermarkets, etc. which would not have been possible with the prior art structure.

It is also beneficial that different 'J' shaped channels profiles can be used in conjunction with one another in the same assembly and can be accommodated on modular bracket components chosen to match the profiles.

Rearrangement of an existing assembly on site, either by addition of more racks or removal of racks, can be undertaken without difficulty. This would not be possible with a fixed bracket system designed to cater for predetermined numbers of tiers. For example, a fixed (integral) three tier bracket assembly could not be converted to a two tier assembly without removing the entire assembly (and its contents) and replacing it with a fixed two tier bracket or visa versa. This modular bracket construction easily caters for such conversion by simply removing or adding bracket sections and racks as required for seasonal changes of displays, maintenance or the like. Retrofitting of the bracket assembly of the present invention to existing installations of a rack system in accordance with the prior art is also possible and practicable.

All leading edges of metalwork coming in contact with the plastic rack components may be protected with a soft PVC or similar plastic 'U' shaped extrusion.

The invention will now be described more particularly with reference to the accompanying drawings which show, by way of example only, five embodiments of a modular tiered rack assembly according to the invention.

BRIEF DESCRIPTION OF THE DRAWINGS

FIGS. 6*b* and 6*c* are enlarged views of detail shown in FIG. 6*a;*

DETAILED DESCRIPTION OF THE PREFERRED EMBODIMENTS

Figure 1:
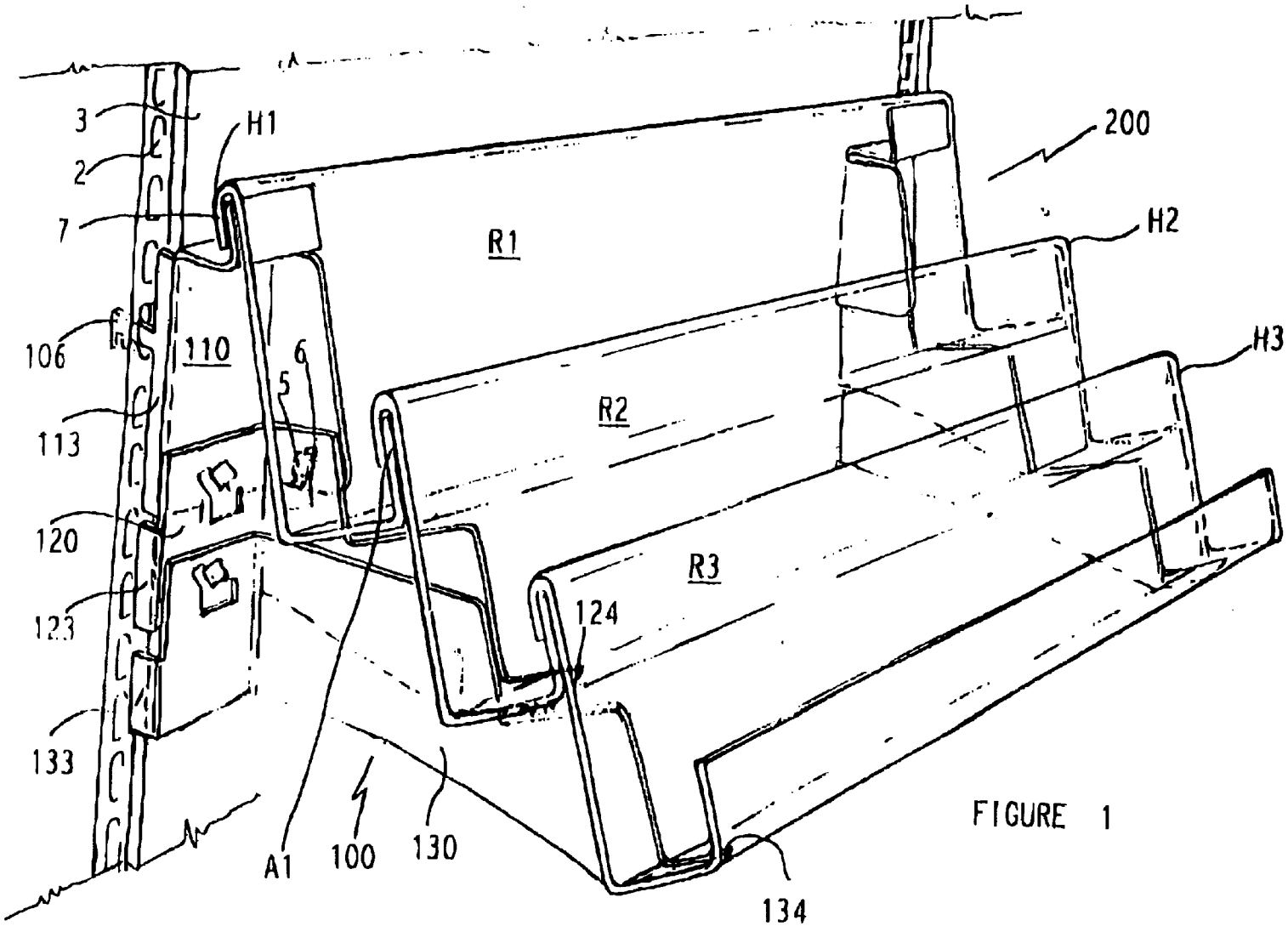
FIG. 1 is a perspective view of a wall mounted rack assembly having three J-shaped racks retained thereon.
Figure 2B:
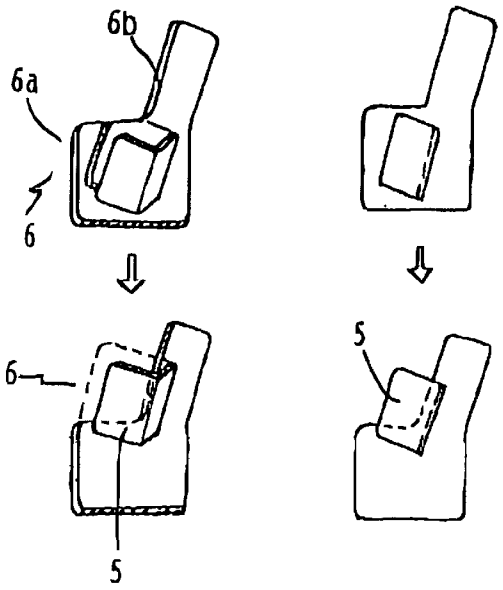
FIG. 2*a* is a perspective view of the three left hand bracket members separated from one another and FIG. 2*b* is a detail showing how these members are assembled for hanging.
Figure 2A:
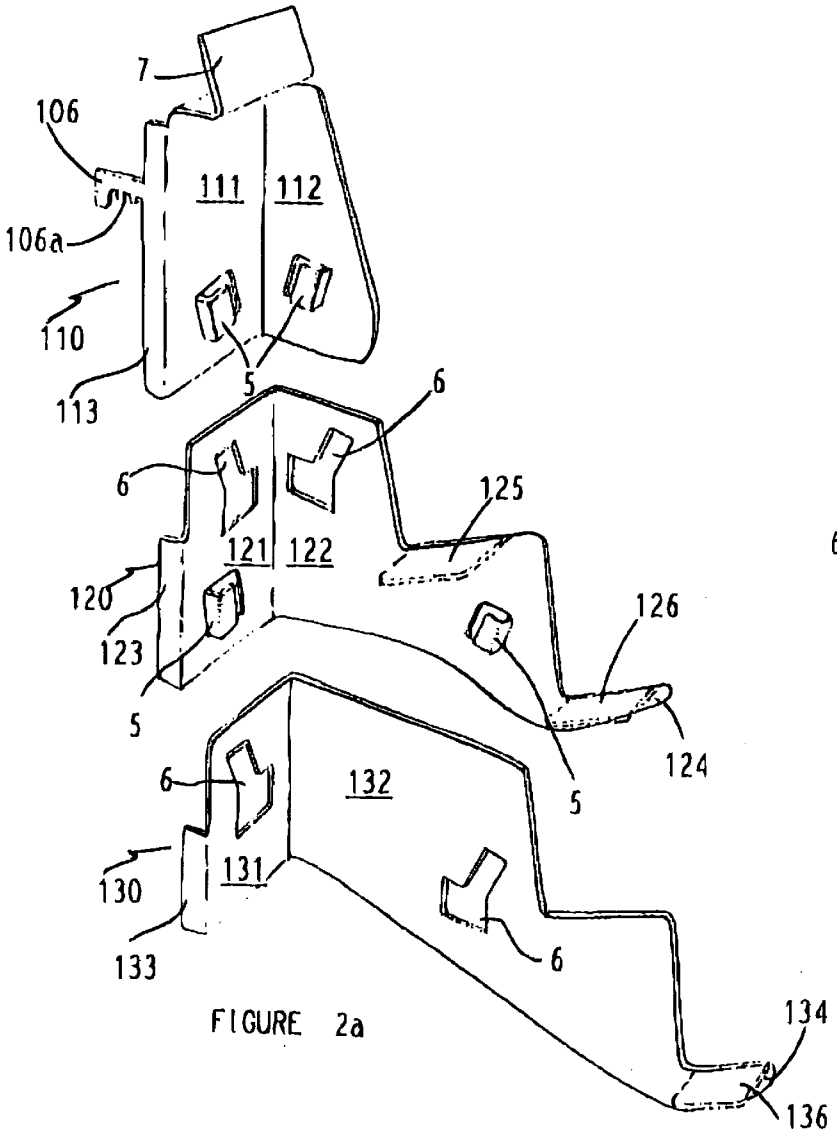
Figure 3:
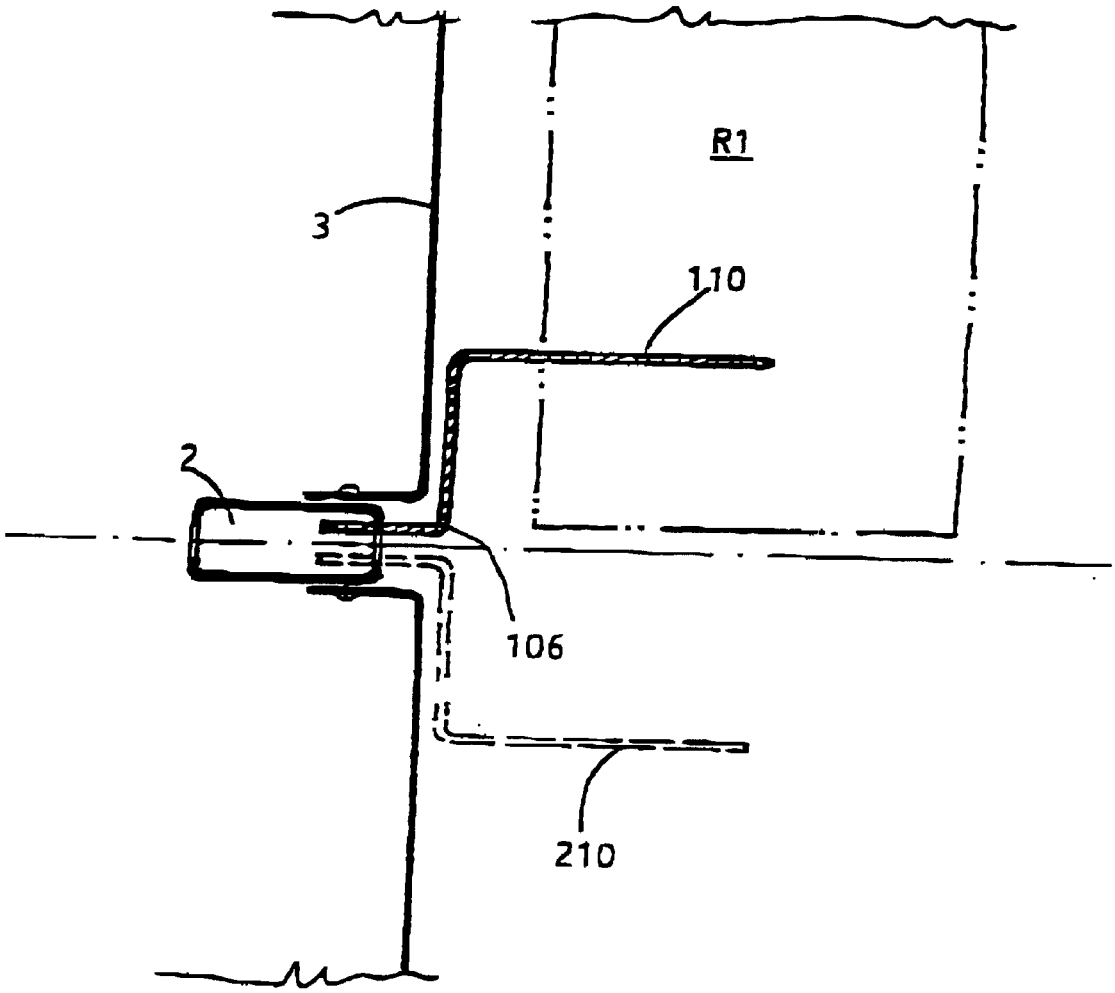
FIG. 3 is a plan view of the arrangement of FIG. 1.
Figure 4:
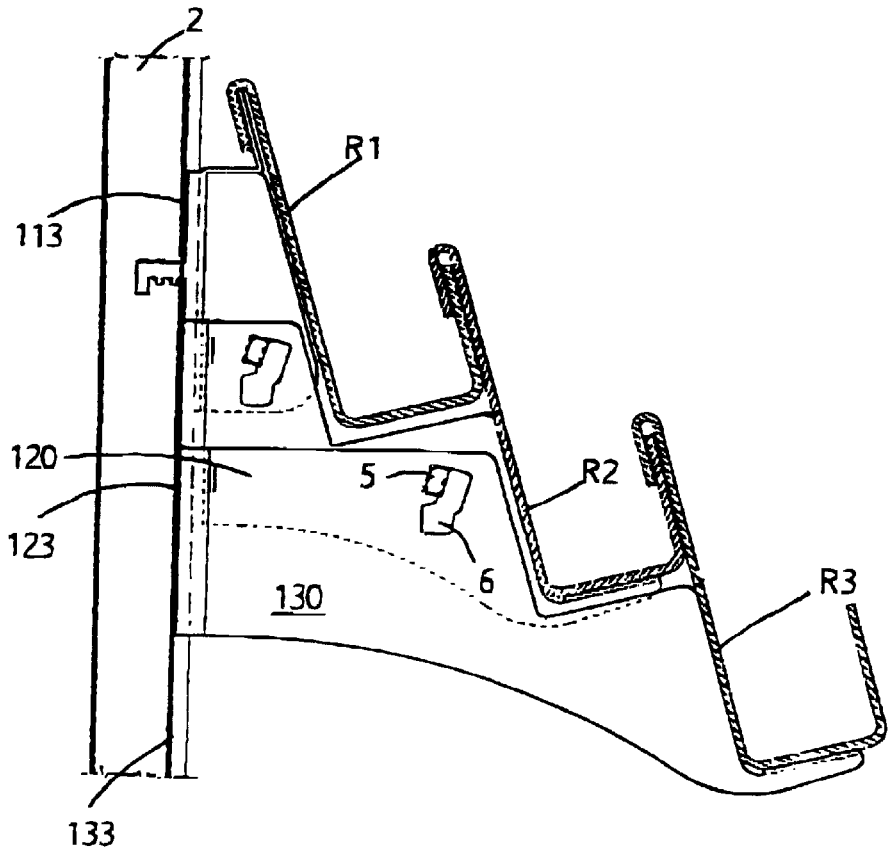
FIG. 4 is an end view of the rack assembly or arrangement, having three J-shaped shelves retained thereon.
Figure 5:
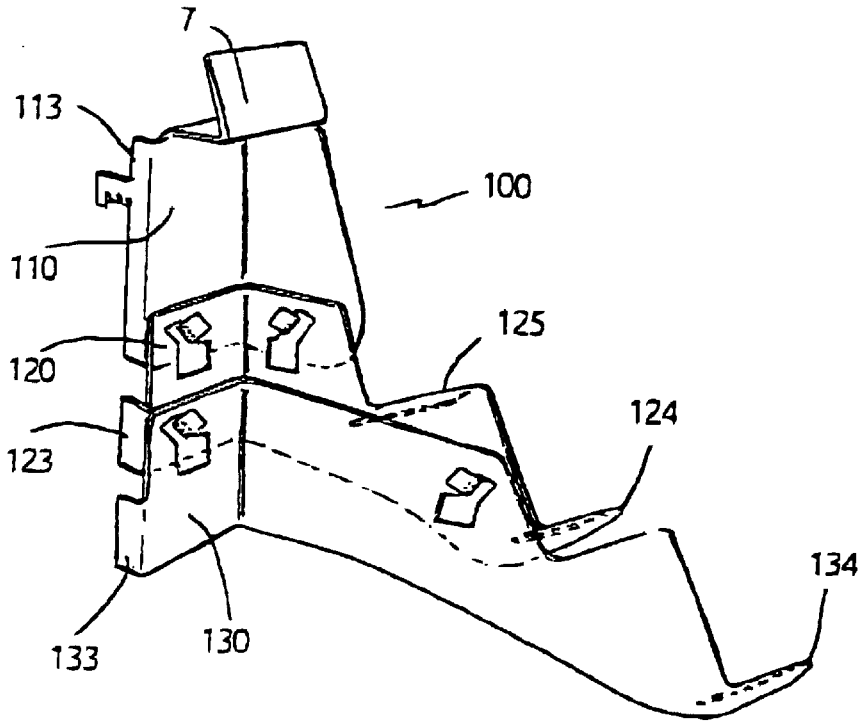
FIG. 5 is a perspective view of the left hand bracket arrangement of FIG. 4 with the racks removed.

Referring now to the drawings, FIGS. 1 to 3 show an exemplary rack assembly in accordance with the first embodiment of the invention in which three J-shaped racks R1 to R3 are assembled onto a pair of supporting bracket arrangements, generally designated 100 and 200. The assembly is secured to a pair of slotted uprights 2 in the manner described below.

As shown in the FIGS. 1 to 3, the exemplary bracket arrangement comprises a left hand bracket set 100 and a right hand bracket set 200, these being mirror images of one another. The bracket set 100 comprises a weight bearing anchor bracket 110 which includes an integrally formed dragon tooth connector 106 which enables the bracket set 100 to be connected to a slotted upright 2. A hanger bracket 120 is removably connectable to the anchor bracket 110 and is suspended therefrom in use. In turn, a hanger bracket 130 is removably suspended from the hanger bracket 120. The dragon tooth connector 106 has several teeth 106*a* which enable it to accommodate variations in depth of the slotted upright 2 and/or adjacent wall or panel 3. For example, as shown in FIG. 3, the upright 2 to which the bracket 110 is connected is recessed compared to the wall panel 3. An appropriate tooth 106*a* of the connector 106 is selected to accommodate the particular depth of the recess. The unbroken lines in FIG. 3 demonstrate the connection of a left hand anchor bracket 110 to the upright 2, while the broken lines show connection of a right hand anchor bracket 210.

Referring to FIG. 2*a* each bracket 110, 120, 130 comprises a pressed metal component, bent about a vertical axis to provide a rear wall 111, 121, 131 and a forwardly extending side wall 112, 122, 132. Each rear wall 111, 121, 131 includes a return 113, 123, 133, bent at 90° to the plane of the rear wall. In use, the return 113, 123, 133 fits about and closely against the edge of the panel 3 which is proud of the upright 2 so that the bracket 100 is prevented from rocking or moving about the connection between the connector 106 and upright 2. In this way, a particularly stable construction is achieved.

The means of assembling the brackets is shown with reference to FIG. 2*a*, and includes a hook in slot engagement as shown in more detail in FIG. 2*b*. Each rear wall and side wall of the brackets 110, 120 has a hook 5, formed by punching and bending the punched portion into a hook shape. Each rear wall and side wall of hanger brackets 120 and 130 is additionally provided with a slot 6, a portion 6*b* of which is angled away from the vertical. To assemble the brackets, the large openings 6*a* of slots 6 of bracket member 120 are offered up to the corresponding hooks 5 of anchor bracket 110 as shown in FIG. 2*a*. When released, the bracket member 120 travels vertically downwardly under its own weight within the portion 6*b* until the limit of travel between the hooks 5 and slots 6 is reached. As the slots 6 are angled, any extra weight acting on the bracket member 120, for example that exerted by a loaded rack will tend to force each slot 6 to move downwardly relative to hook 5, bringing the bracket members 110 and 120 into very secure locking engagement (see right hand drawings of FIG. 2*b*). The next hanger bracket 130 is then placed in like manner onto bracket 120, by hanging slots 6 of bracket 130 over hooks 5 of bracket 120 and allowing the bracket 130 to fall under its weight until securely engaged with bracket 120. Any desired number of additional brackets can be added onto the assembly in like fashion. Although not shown in FIG. 2*a*, the hanger bracket 130 and indeed, all hanger brackets, would normally be provided with both hooks 5 and slots 6 to provide maximum flexibility in the provision of an adjustable display which can readily be altered as required. The assembly of the various bracket members together may be done either before or after the connection of the anchor bracket to the slotted upright.

The bracket set 200 comprises like parts and is assembled in like manner.

Figure 6B:
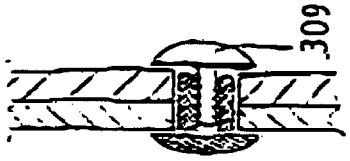
Figure 6B:
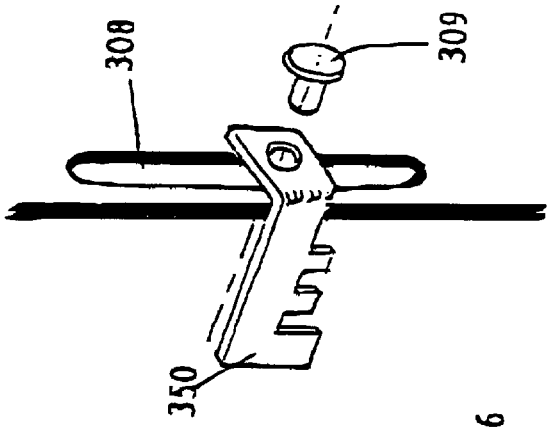

Once the bracket sets 100 and 200 have been put in place, the J-shaped channel racks can be arranged over the brackets, as will now be described. As can be seen from FIG. 2*a*, the anchor bracket 110 includes at its upper side a projection 7, over which the hooked portion H1 of the long arm of J-shaped rack R1 fits. Rack R1 is thus supported by being suspended from the anchor brackets 110, 210. A second rack R2 is then attached to the assembly by having its upper hook H2 placed over the upstanding short arm A1 of rack R1. The base of rack R2 is supported on the landing 124 of hanger bracket 120. Next, a third rack R3 is hooked over rack R2 by hook H3, and its base is supported by landing 134 of hanger bracket 130. Optional additional support for racks R1 and R2 may be provided by the provision of support platforms 125, 126 respectively on bracket 120, 136 on bracket 130 or on any other hanger bracket. Any desired number of shelves can be added by the simple provision of additional hanger brackets, all of which are ultimately suspended from the anchor bracket via intervening hanger brackets. With the exception of the uppermost rack R1 of the tier, all the racks are supported from underneath by a bracket landing and thus the racks can carry heavier weights than racks which are suspended one from another and supported by struts projecting onto back panels. As each rack is added to the assembly, and subsequently loaded with merchandise, it causes the brackets to travel further downwardly over hooks 5, which due to the angled disposition of the slot portions 6*b* causes the brackets to lock together as described above, resulting in a very stable construction. The second embodiment of the invention is a modification of the first embodiment and like parts will be given like numerals in FIGS. 6*a*,6*b* and 6*c*.

Figure 6A:
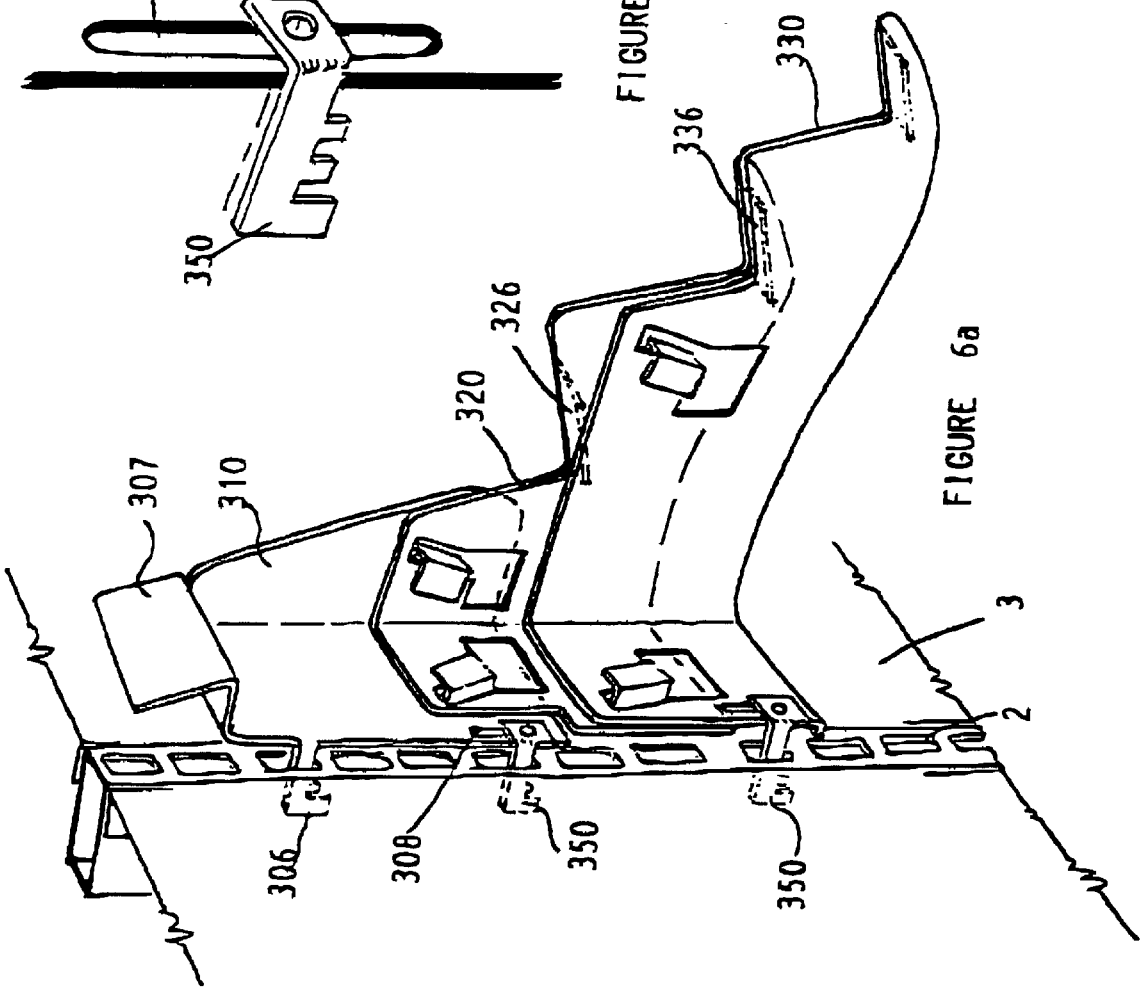
FIG. 6*a* is a perspective view of three left hand bracket members of a second embodiment of rack system according to the invention.

In a case where the slotted face of the uprights 2 is flush with wall or panel 3, as shown in FIG. 6*a*, then the brackets 310,320,330 can not be stabilised against rocking by the provision of a return 113, 123, 133 as in FIGS. 1 to 5. In the second embodiment, the required stability can be provided by providing a second dragon tooth connector 350 on anchor bracket 310 in addition to the first dragon tooth connector 306. At the distance between centres on the slotted uprights 2 can vary from system to system, the second connector 350 is an adjustable connector which is movable vertically relative to the anchor brackets, in slot 308 of bracket 310, so as to be able to accommodate various distances between slots in the uprights 2. The second connector 350 may be locked on the anchor bracket for extra security, for example by screw 309. An additional second connector 350 is also provided on the hanger bracket 330. Bracket 310 includes a projection 307 similar to and for the same purpose as projection 7 of bracket 110 of the first embodiment. Lands 326 and 336 are provided on the brackets 320 and 330 respectively to support the bases of the racks R2 and R3. This second embodiment also functions where the infill panels are proud of the structure.

Figure 7:
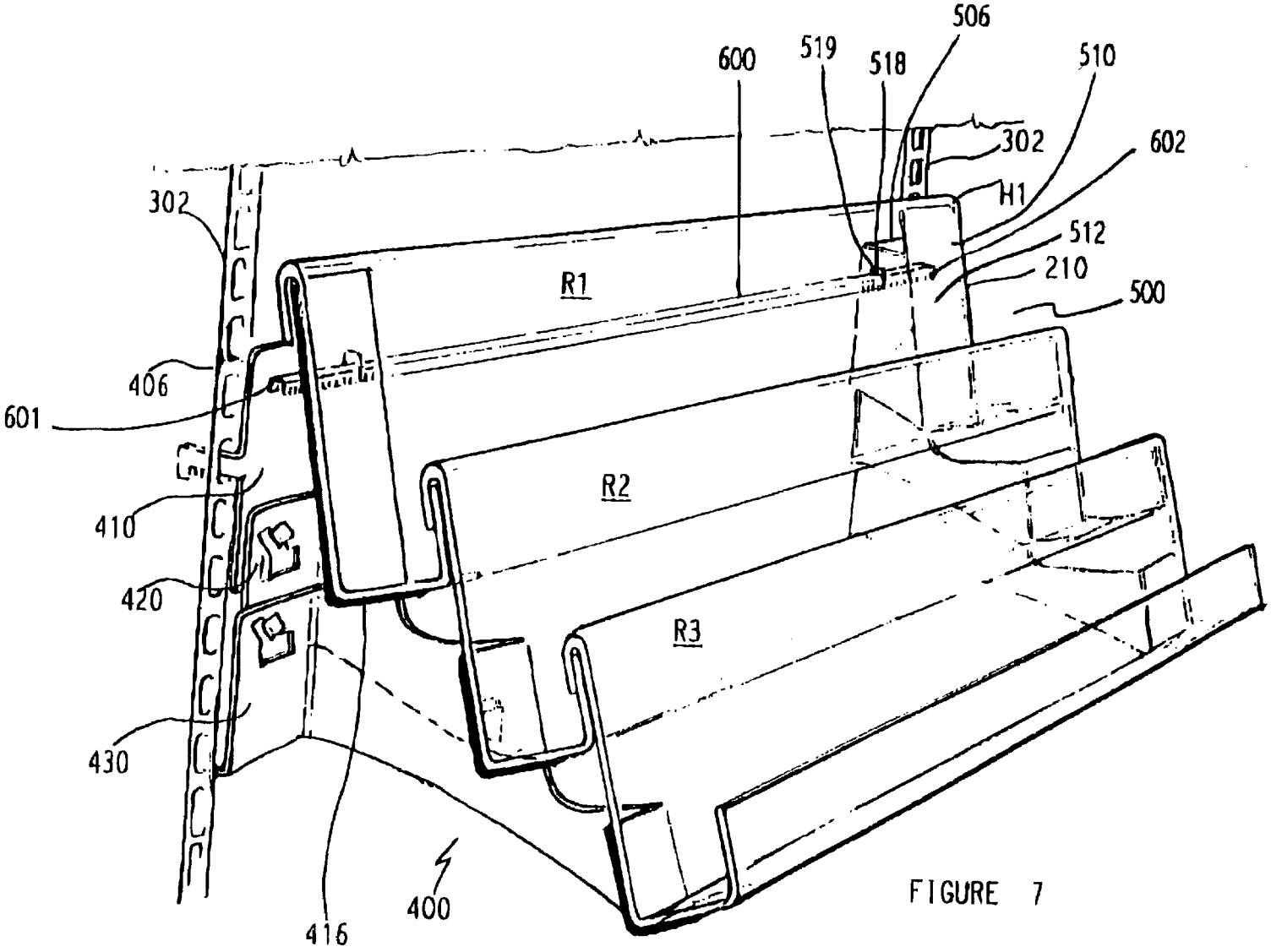
FIG. 7 is a perspective view of a third embodiment which comprises a suspended rack assembly, on typical modular metal shelving equipment having three J-shaped racks retained thereon and including a tie bar stabiliser.
Figure 9A:
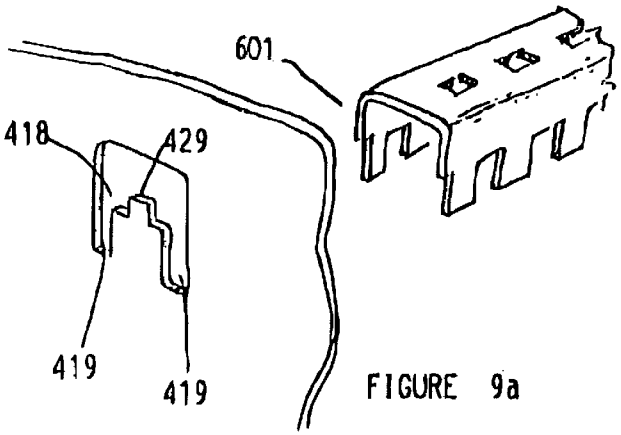
FIG. 9*a* is an enlarged view showing the interlocking components of the hanger bracket and tie bar stabiliser prior to the connection thereof.
Figure 9B:
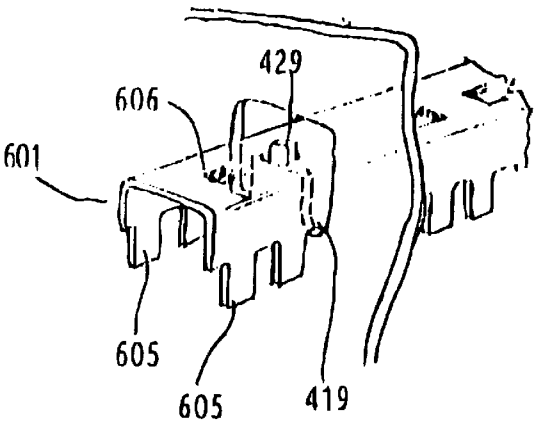
FIG. 9*b* is an enlarged view of the connection between the tie bar stabiliser and bracket.
Figure 8:
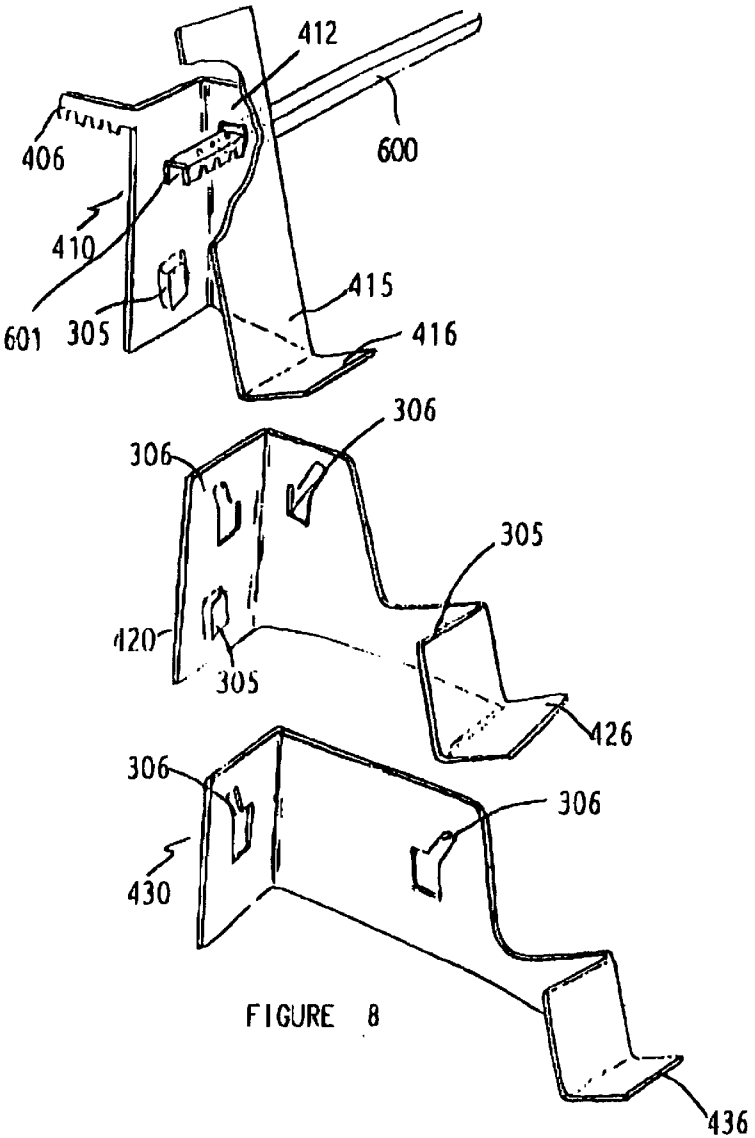
FIG. 8 is a perspective view of three left hand brackets of the third embodiment separated from one another and one end of the tie bar stabiliser.

FIGS. 7 to 9 show an exemplary rack assembly of the third embodiment in which three J-shaped channel racks R1 to R3 are assembled onto a pair of supporting bracket arrangements, generally designated 400 and 500. The assembly is secured to a pair of slotted uprights 302 in the same manner as in the first embodiment with like parts having similar numbers except with the respective change of the first digit.

The two bracket sets 400 and 500 are connected together by a toothed tie-bar 600 which engages in a locking orifice 418, 518 respectively in the faces 412 and 512 of brackets 410, 510. The brackets 410, 510 are thus prevented from rocking or moving about the connection between the connectors 406 and 506 and uprights 302. In this way, a particularly stable construction is achieved for both flush and proud panel conditions.

The ends 601, 602 of toothed bar 600 are provided with a series of teeth 605 and orifices 606 to allow engagement with the locking orifices 418, 518 in the brackets 410, 510. Each orifice 418, 518 has a pair of channels 419, 519 to engage with teeth 605 and a peg 429, 529 which engages in an orifice 606. Optionally, a further tie bar 600 can be used to connect the second tier brackets 420 or third tier brackets 430 to make the structure even more rigid.

Due to the number of teeth 605 at each end 601, 602, the same length of tie bar can be used to secure bay widths of up to 100 mm variation in width. Therefore, a tie bar of 1300 mm in length can be used for bay widths of 1200 mm, 1220 mm (4 feet), 1250 mm and 1300 mm which are all standard sizes in the industry, with the ends 601, 602, being accommodated out of sight within the bracket structure. Similarly 900 mm and 1000 mm bay module sizes also standard within the industry can also be accommodated with a common tie bar. Similarly 500–600 mm bay widths can be provided with a common tie bar.

Once the bracket sets 400 and 500 have been put in place, and secured by the bars 600, the J-shaped channel racks can be arranged over the brackets, as in the previous embodiments. The anchor bracket 410 includes the front wall 415 over which the hooked portion H1 of the long arm of J-shaped rack R1 fits and the base of the rack R1 is supported by landing 416. A second rack R2 is then attached to the assembly by having its hook H2 placed over the upstanding short arm A1 of rack R1. The base of rack R2 is supported on the landing 426 of hanger bracket 420. Next, a third rack R3 is hooked over rack R2, and rests as shown in FIGS. 14 and 15 with its base supported by landing 436 of hanger bracket 430. Any desired number of racks can be added by the simple provision of additional hanger brackets, all of which are ultimately suspended from the anchor bracket via intervening hanger brackets.

The fourth embodiment of shelving system will now be described with respect to FIGS. 10 to 13. It is similar to the third embodiment with some important distinctions which will be described in more detail. The features which are similar to the features of the earlier embodiments will not be explained in detail.

Figure 10:
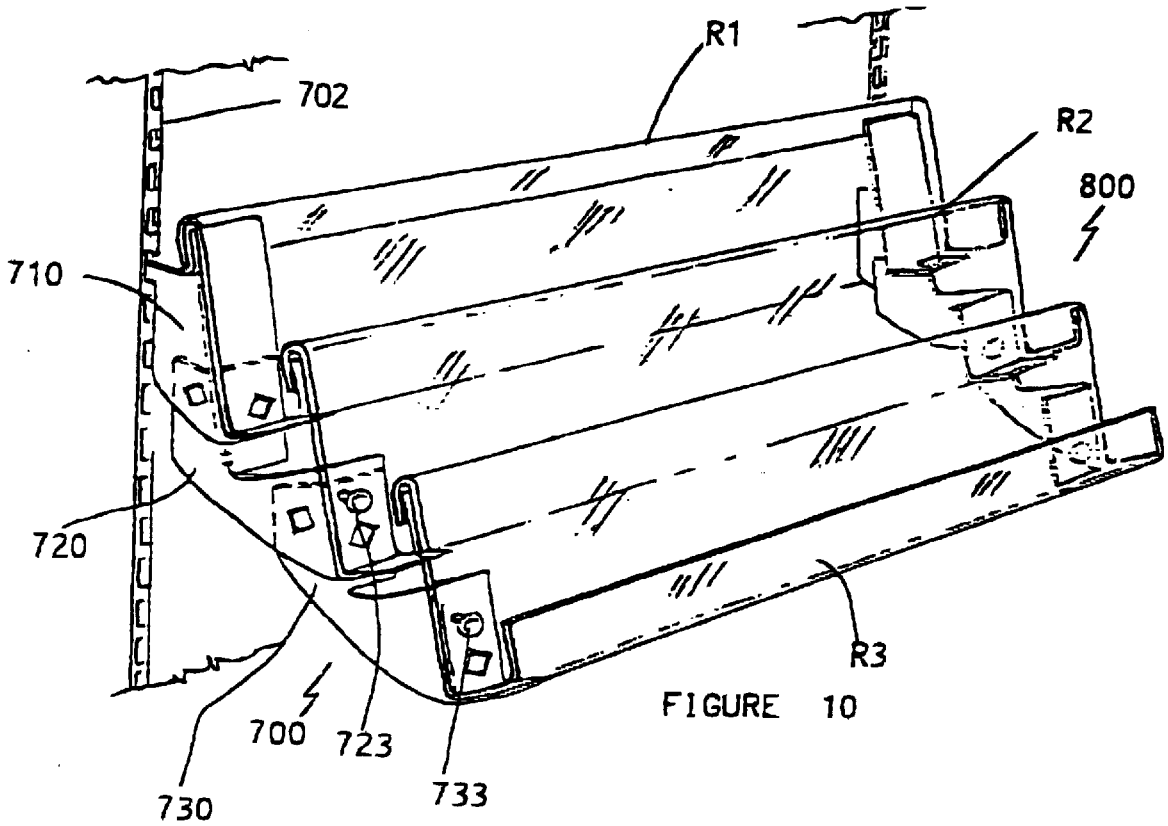
FIG. 10 is a perspective view of a fourth embodiment of rack system according to the invention, featuring an alternative tie bar/stabiliser arrangement and modified hanger brackets.
Figure 11A:
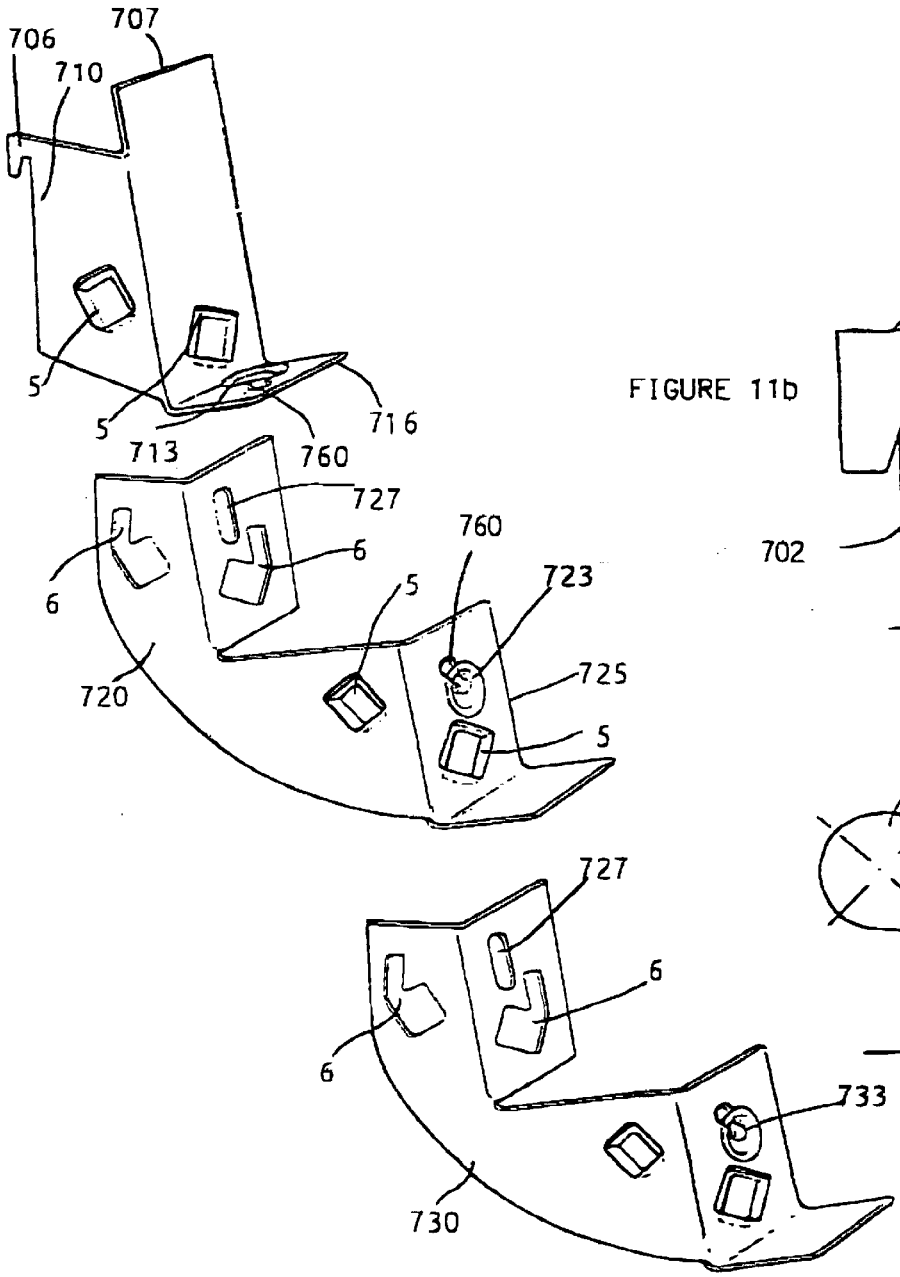
FIG. 11*a* is an exploded perspective view showing the anchor bracket and hanger brackets of the fourth embodiment of rack system.
Figure 11B:
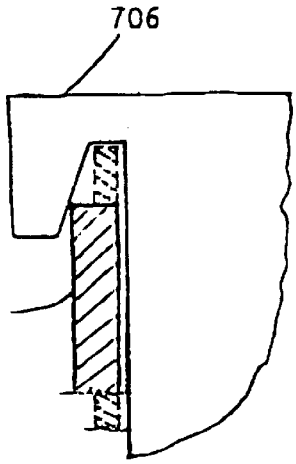
FIGS. 11*b* and 11*c* show respectively an enlarged detail view of a hanging rib of the anchor bracket and a suction cap retaining slot of the stabiliser arrangement.
Figure 11C:
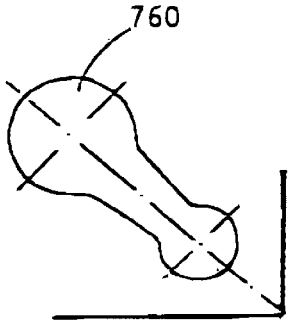

The fourth embodiment includes a left hand bracket set 700 shown in FIG. 10 and a mirror image right hand bracket set 800. The bracket set 700 comprises a weight bearing anchor bracket 710 which includes an integrally formed angled tooth connector 706 which enables the bracket set to be connected to a slotted upright or a thicker cast support section 702 as shown in Figure 11*b*. Hanger bracket 720 is removably connectable to anchor bracket 710 and is suspended from anchor bracket 710. The major distinction between the anchor bracket 710 and the anchor brackets of previous embodiments is that it is connected to and supported by the slotted metal upright alone, independent of contact with or support by a back panel element of the support structure. The major distinction between the hanger bracket 720 and the hanger brackets of the previous embodiments is that it is totally supported by the anchor bracket 710 and does not come in contact with the upright supports or back panels of the shelving system structure. Thus, a further identical hanger bracket 730 can be suspended from the hanger bracket 720 and so on to provide a bracket support for a third, fourth and further racks as desired from a common hanger bracket member. In previous embodiments the 2nd,3rd and 4th brackets were all different shapes which necessitated separate tooling, production, stock handling etc. The brackets of the fourth embodiment are also of much simpler design and more material efficient and less expensive to produce tan the previous embodiments.

A rack hung between a left hand bracket 700 and similar right hand bracket 800 may serve as the tie bar, due to suitable fixing means being provided to connect the rack to the brackets. A fixing means (see FIG. 11*a*) can comprise a suction pad 713 extending through a keyhole slot 760 in the landing 716 of the bracket 710 so that when a rack is hooked over upstand 707 and pressed home against the landings 716 of the brackets, the suction pads 713 engage and adhere to the base of the rack, creating a tie bar effect, preventing any tendency of the brackets to move apart. A suction pad 723 is provided on front wall 725 of the hanger bracket 720 so that when a second tier rack is hooked over a first tier rack and pressed home against the front walls 725, the suction pads 723 engage and adhere to the back of the rack creating another tie bar effect. The same applies to third tier (suction pad 733), fourth tie etc. The brackets 720, 730 have a slot 727 to accommodate the rear of the suction pads 713,723.

This integral/stablising tie bar arrangement eliminates the need for additional sliding key mechanisms or additional toothed tie bar solutions to the stability problem as illustrated in previous embodiments.

Figure 12:
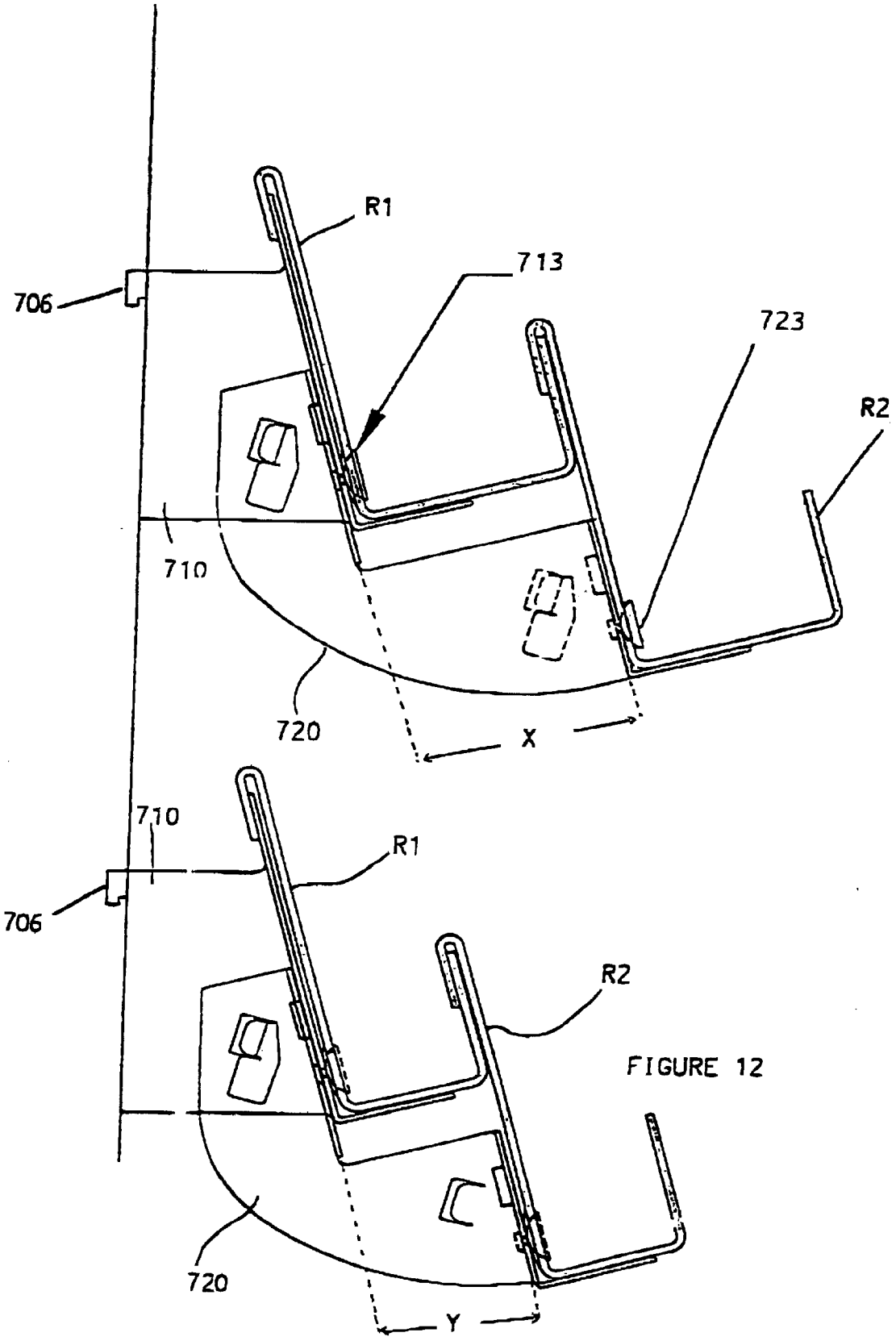
FIG. 12 is a side view of two bracket and rack combinations of the fifth embodiment having different depths of racks.
Figure 13:
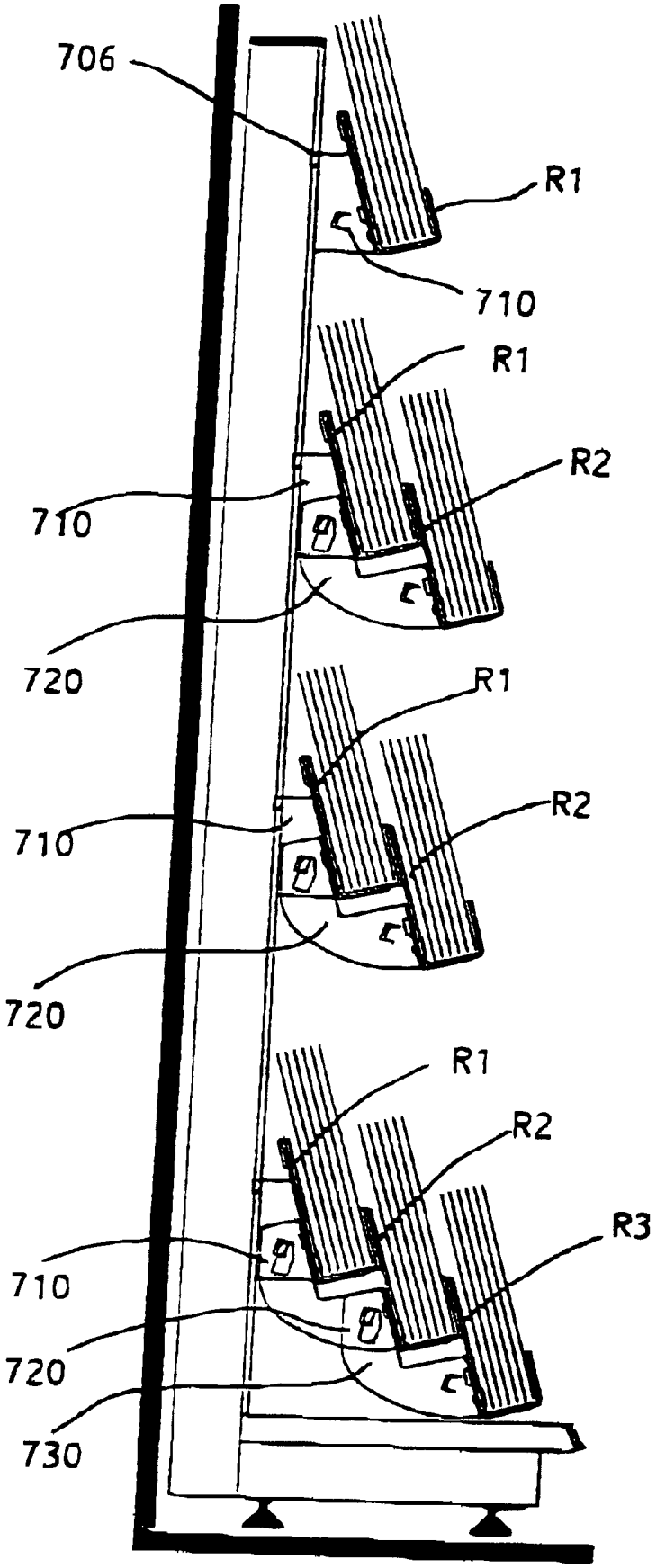
FIG. 13 is an end view of a typical modular metal shelving system employing various bracket and rack combinations of the fifth embodiment as shown in FIGS. 10 and 12.

As shown in FIG. 12 racks R1 and R2 having different depths X and Y can be used to accommodate different quantities of products, with the brackets 720 being of different dimensions to support the racks having dimensions X and Y. A typical display using combinations of the same sized racks is shown in FIG. 13.

Figure 14A:
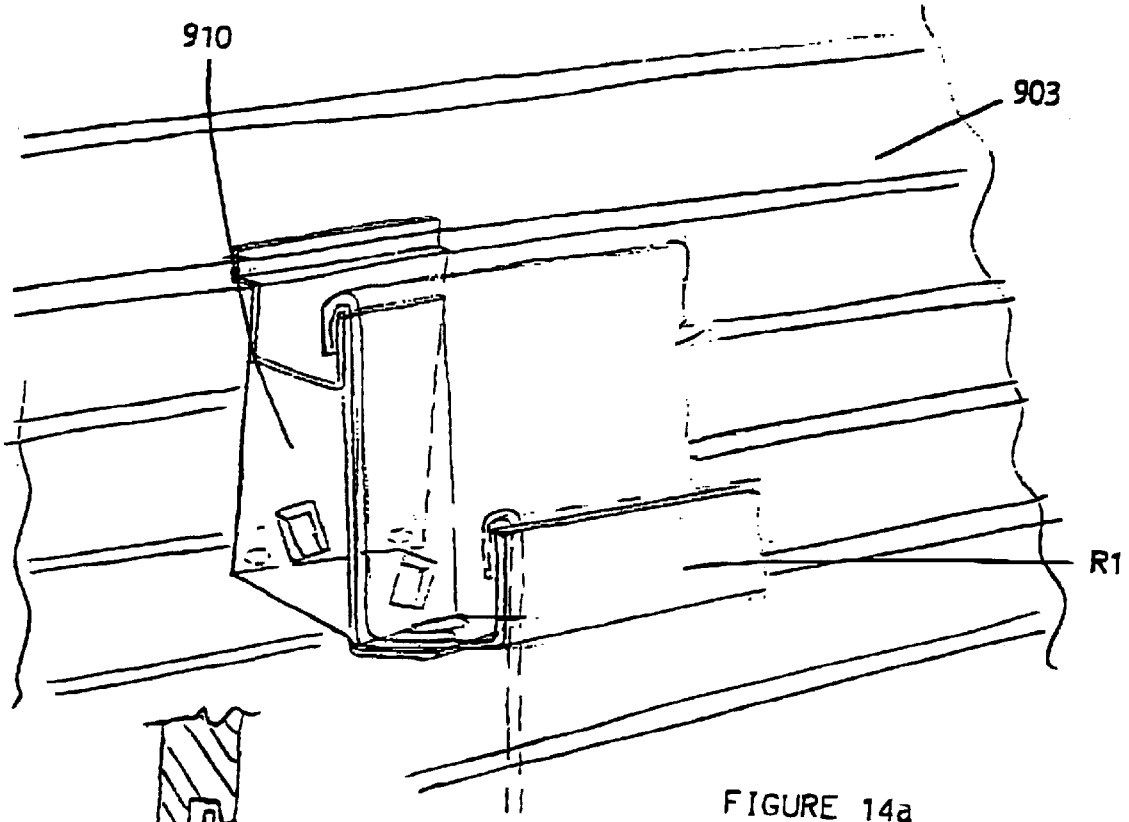
FIGS. 14*a* and 14*b* are respectively a perspective view and a side view of a hanger bracket of a fifth embodiment modified to be connected to slat wall panelling.
Figure 14B:
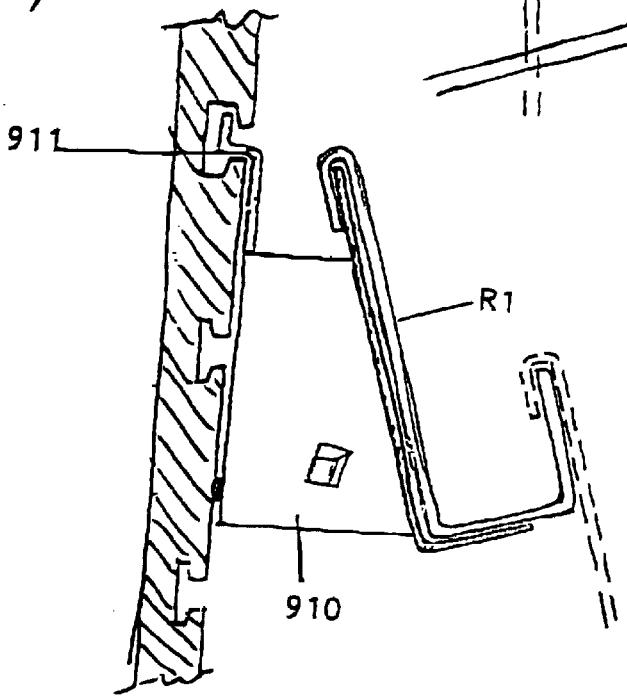

As shown in FIGS. 14*a* and 14*b*, the fifth embodiment includes an anchor bracket 910 which can be hung from other support structures, such as slat wall panelling 903. The bracket 910 has a dog leg connector 911 as shown. Rack R1 is then suspended from the bracket 910 as in previous embodiments.

It will of course be understood that the invention is not limited to the specific details described herein, which are given by way of example only, and that various modifications and alterations are possible within the scope of the invention as defined in the appended claims

What is claimed is:

1. A modular rack or shelf assembly comprising a pair of anchor brackets, each bracket being removably engageable with a generally upright support member and each bracket including means for supporting a demountable display rack or shelf spanning between the brackets, characterised in that the assembly further includes an elongate tie element removably engageable with each bracket, the tie element and/or bracket having fixing means for enabling the tie element and bracket to be securely connected to one another to provide a stable construction.

2. An assembly as claimed in claim 1, in which one or more hanger brackets are connectable to the anchor brackets and to other hanger brackets so connected, each being removably suspendable from the lowest previously suspended anchor bracket or hanger bracket to construct a tiered merchandise display support structure.

3. An assembly as claimed in claim 1, in which the rack or shelf functions as the tie element, with each bracket having fixing means for fastening the rack or shelf thereto.

4. An assembly as claimed in claim 3, in which the fixing means comprises suction pads fixed to the brackets.

5. An assembly as claimed in claim 1, in which the elongate tie element comprises a tie bar engageable to and between the brackets.

6. An assembly as claimed in claim 5, in which the fixing means comprises a pair of toothed ends on the tie bar and a locking orifice in each bracket, each toothed end being engageable with a locking orifice.

7. An assembly as claimed in claim 6, in which each toothed end includes a plurality of teeth spaced along the length of the tie bar so that variations in the width of the rack or shelf can be accommodated by the same length of tie bar.

8. An assembly as claimed in claim 6, in which the fixing means further include an orifice formed in the toothed end of the tie bar, said orifice being engageable with a peg provided in the locking orifice in the bracket.

9. A modular tiered rack or shelf assembly comprising at least two merchandise support racks or shelves suspended in a tiered configuration and rack or shelf support means for fixing the tier of racks or shelves to a support structure or surface, each rack or shelf having formations which enable it to be removably fixed to the support means and/or to the rack or shelf above it in the tiered configuration, the rack or shelf support means comprising an anchor bracket engageable with the support structure or surface and the uppermost rack or shelf, characterised in that the rack or shelf support means includes at least one hanger bracket which is removably engageable with the anchor bracket, with at least one of the anchor or hanger brackets having means for supporting the base of a rack or shelf.

10. An assembly as claimed in claim 9, in which further hanger brackets are connectable to the assembly, each being removably engageable with the lowest previously suspended hanger bracket to provide a tiered support structure for the racks or shelves.

11. An assembly as claimed in claim 9, in which the anchor and hanger brackets are engageable by means of co-operating formations formed in the anchor and hanger brackets.

12. An assembly as claimed in claim 11, in which the co-operating formations comprise a hook element formed in one bracket and a slot formed in the other bracket.

13. An assembly as claimed in claim 12, in which each hanger bracket is provided with both a hook element and a slot to enable the hanger bracket to be connected with a higher and lower bracket in the tiered assembly.

14. An assembly as claimed in claim 13, in which the slot is angled from vertical, and the slot in a hanger bracket to be connected to another bracket co-operates with the hook element of the lowest bracket of the tiered assembly, so that the newly-connected bracket drops under its own weight until the hook element and slot interengage tightly by abutment to secure the brackets together.

15. An assembly as claimed in claim 1 in which the anchor bracket is engageable with a support structure or surface by fixing means.

16. An assembly as claimed in claim 15, in which the fixing means comprises a key engageable with a slot in the support structure or surface.

17. An assembly as claimed in claim 16, in which the key includes a plurality of fixing positions to enable the spacing between the support structure or surface and the anchor bracket to be adjusted, whereby variations in the distance between the support surface slot and the surface against which the anchor bracket bears in use can be accommodated by the same anchor bracket.

18. An assembly as claimed in claim 16, having at least one further fixing means associated with the anchor bracket and/or the connected hanger bracket, to provide extra stability against rocking or rotation of the assembly.

19. An assembly as claimed in claim 18, in which the further fixing means is vertically slidable relative to the anchor or hanger brackets, whereby when the assembly is supported on slotted uprights, the slidable fixing means enables the assembly to be secured to two positions on the upright irrespective of variations between slot centres on the upright.

20. An assembly as claimed in claim 1, in which the anchor or hanger bracket comprises a stepped portion for supporting the base of a rack or shelf.

21. An assembly as claimed in claim 1, in which the brackets are arranged in two or more pairs, with each pair supporting a rack or shelf at its end and the brackets of each pair being mirror-images of one another.

22. An assembly as claimed in claim 1, in which the anchor and/or hanger brackets include means for stabilizing the assembly against movement relative to the support structure.

23. An assembly as claimed in claim 22, in which the stabilizing means comprises a return for engaging about an edge of the support structure.

24. An assembly as claimed in claim 1 in which one or more pairs of brackets includes means for fastening a rack or shelf thereto to enable the rack or shelf to act as a tie element between the brackets of a pair.

25. An assembly as claimed in claim 1 in which the racks or shelves are of a metal or plastics material or a mixture thereof.

26. An assembly as claimed in claim 9, in which the anchor bracket is engageable with a support structure or surface by fixing means.

27. An assembly as claimed in claim 26, in which the fixing means comprises a key engageable with a slot in the support structure or surface.

28. An assembly as claimed in claim 27, in which the key includes a plurality of fixing positions to enable the spacing between the support structure or surface and the anchor bracket to be adjusted, whereby variations in the distance between the support surface slot and the surface against which the anchor bracket bears in use can be accommodated by the same anchor bracket.

29. An assembly as claimed in claim 27, having at least one further fixing means associated with the anchor bracket and/or the connected hanger bracket, to provide extra stability against rocking or rotation of the assembly.

30. An assembly as claimed in claim 29, in which the further fixing means is vertically slidable relative to the anchor or hanger brackets, whereby when the assembly is supported on slotted uprights, the slidable fixing means enables the assembly to be secured to two positions on the upright irrespective of variations between slot centers on the upright.

31. An assembly as claimed in claim 9, in which the anchor or hanger bracket comprises a stepped portion for supporting the base of a rack or shelf.

32. An assembly as claimed in claim 9, in which the brackets are arranged in two or more pairs, with each pair supporting a rack or shelf at its end and the brackets of each pair being mirror-images of one another.

33. An assembly as claimed in claim 9, in which the anchor and/or hanger brackets include means for stabilizing the assembly against movement relative to the support structure.

34. An assembly as claimed in claim 33, in which the stabilizing means comprises a return for engaging about an edge of the support structure.

35. An assembly as claimed in claim 9, in which one or more pairs of brackets includes means for fastening a rack or shelf thereto to enable the rack or shelf to act as a tie element between the brackets of a pair.

36. An assembly as claimed in claim 9, in which the racks or shelves are of a metal or plastics material or a mixture thereof.

* * * * *